US005215352A

United States Patent [19]

Yeh et al.

[11] Patent Number: 5,215,352

[45] Date of Patent: Jun. 1, 1993

[54] ADJUSTABLE SEAT ASSEMBLY FOR A WHEELED CHAIR

[75] Inventors: Bean-Shung Yeh; Wu-Yaw Wei; Bee Su; Lin-Yun Wu, all of Hsin Chu, Taiwan

[73] Assignee: Industrial Technology Research Institute, Chutung Town, Taiwan

[21] Appl. No.: 808,184

[22] Filed: Dec. 13, 1991

[51] Int. Cl.[5] ..... A47C 1/02

[52] U.S. Cl. ..... 297/328; 297/317; 297/322

[58] Field of Search ..... 297/328, DIG. 4, 327, 297/317, 320, 322, 368, 369

[56] References Cited

U.S. PATENT DOCUMENTS

| | | | |
|---|---|---|---|
| 2,712,346 | 7/1955 | Sprinkle | 297/317 |
| 3,198,575 | 8/1965 | Hawkins | 297/328 |
| 4,079,990 | 3/1978 | McMunn et al. | 297/322 X |
| 4,732,423 | 3/1988 | Condon | 297/328 X |

*Primary Examiner*—Laurie K. Cranmer
*Attorney, Agent, or Firm*—W. Wayne Liauh

[57] ABSTRACT

An adjustable chair seat, of which the angle of the back frame, the seat width, and the seat depth may be adjusted; the arm rest assemblies can also be turned backwards at an angle of 120°; the side frames can also be turned outwards at a horizontal position so as to provide a user with comfortable and convenient operation and use.

6 Claims, 7 Drawing Sheets

ADJUSTABLE SEAT ASSEMBLY FOR A WHEELED CHAIR

BACKGROUND OF THE INVENTION

In the conventional wheeled chairs, the back frame and seat width thereof can be adjusted; for instance, the moving angle of the back frame of such chair is usually controlled by means of an electric motor, or an air-compressed cylinder, or a spring. However, a back frame controlled with a motor would involve a complex structure to cause a higher manufacturing cost. The air-compressed cylinder or the spring type of chair-back frame has a simple structure and a lower cost; however, such a chair-back frame should be operated by another person in case of a user suffering from S.G.I. because of the frame having no power structure. The seat width of such a chair can be adjusted by moving a sleeve pipe to change the space between the arm rest and the side frame thereof; the sleeve pipes are usually fixed by means of screw bolts. The seat depth of the aforesaid chair is unable to adjust for persons having different body sizes. Further, the conventional chair has its arm rests and side frames assembled together into a single piece, which has to be disassembled whenever a user moves from the chair to another seat or the like; therefore, it is deemed an inconvenient structure in terms operation by a user.

SUMMARY OF THE INVENTION

This invention relates to an adjustable seat assembly for a wheeled chair, and particularly to a wheeled chair, of which the chair back frame, the seat width and the seat depth thereof are adjustable; further, the arm rests each can be turned backwards at an angle of 120°, and can also be turned outwards at a horizontal position. The aforesaid chair seat assembly comprises a main frame, a seat frame, a back frame and a pair of side frames. An extension screw bolt is used for adjusting the width between the arm rests, and for turning the arm rests backwards. The seat depth is also adjusted by means of an extension screw bolt. The side frame and the arm rests two independent assemblies. In the round pipe under the said frame, there are springs, adjustable rods, and fixing pins, whereby the side frames can be fixed to the side frame bases respectively. The side frame can be set outwards at a horizontal position upon the same being pushed forwards slightly so as to have a user moved from, the chair to another seat or the like smoothly. The main frame is mounted with a coupling rod assembly for adjusting and setting the chair back frame at an angle desired. When a control rod in the assembly is pushed outwards, the pin end of the control rod will be disengaged from one of the holes of a disk; then, the control rod may be pushed back and forth freely, and in turn a sliding block moved by the coupling rod will cause the side frame base to move; as a result, the back frame will be turned around a back frame shaft so as to adjust the chair at an angle desired to meet a user's requirement.

The prime object of the present invention is to provide an adjustable seat assembly for a wheeled chair, in which a coupling rod assembly is used for adjusting the angle of the chair back. As soon as the aforesaid adjustment is done, the control rod will be engaged automatically in one of the holes on the disk as a result of a spring force, and then the chair angle is set in place.

Another object of the present invention is to provide an adjustable seat assembly for a wheeled chair, in which an extension screw bolt and a pin are used to enable the arm rests to be adjusted at a given space desired, and also enable the arm rest to be turned backwards. Further, an extension screw bolt is used to enable the seat to be adjusted in depth desired so as to fit a user's body size.

Still another object of the present invention is to provide an adjustable seat assembly for a wheeled chair, in which the side frame and the arm rest are designed independently; the arm rest can be turned backwards, and the side frame can be turned outwards at an angle of 90°; the side frame with a plate may be used as a bridge to provide a user with means to move from the chair to another seat or the like.

DETAILED DESCRIPTION

Figure 1:
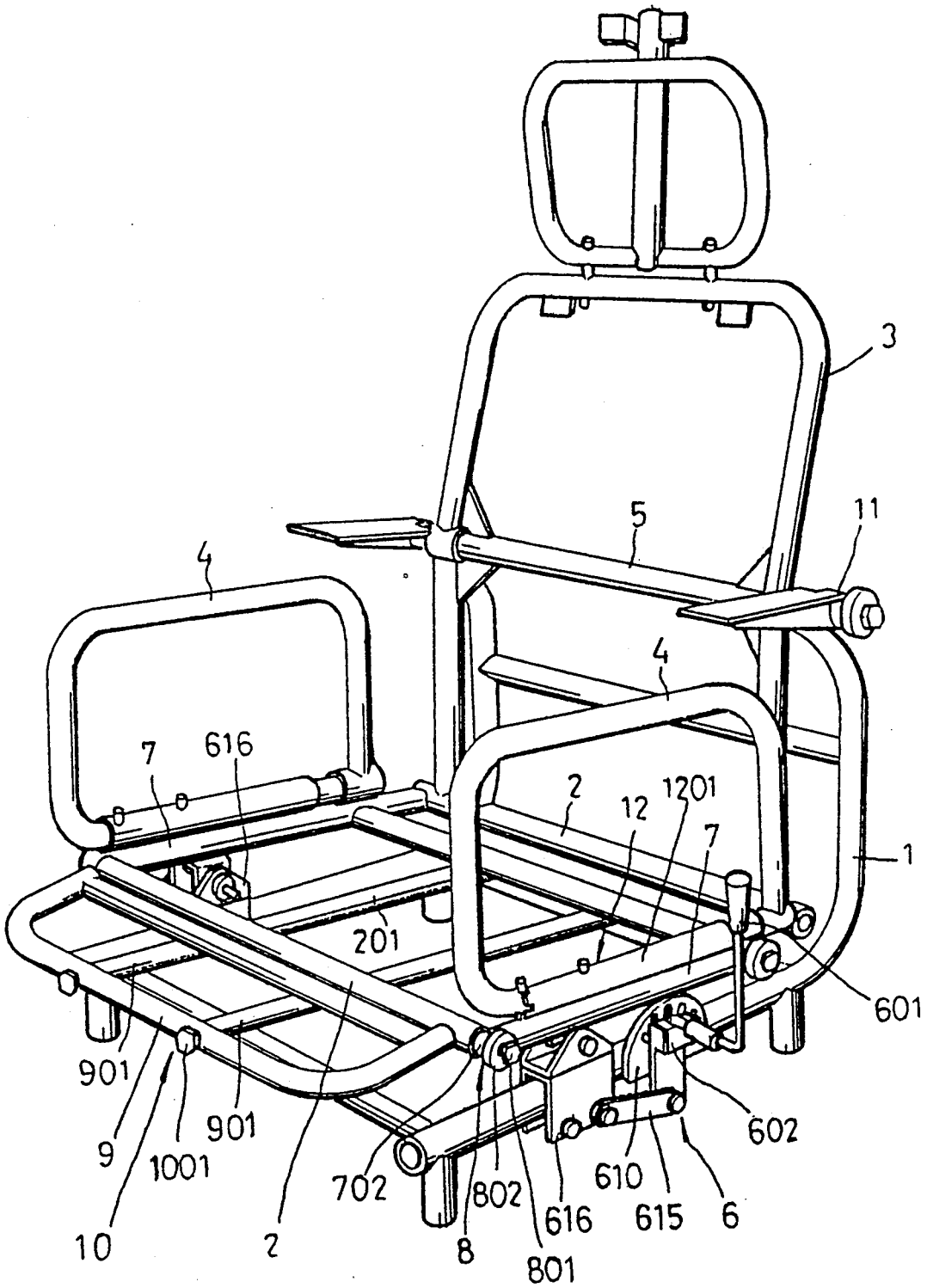
FIG. 1 is a perspective view of an embodiment according to the present invention.
Figure 2:
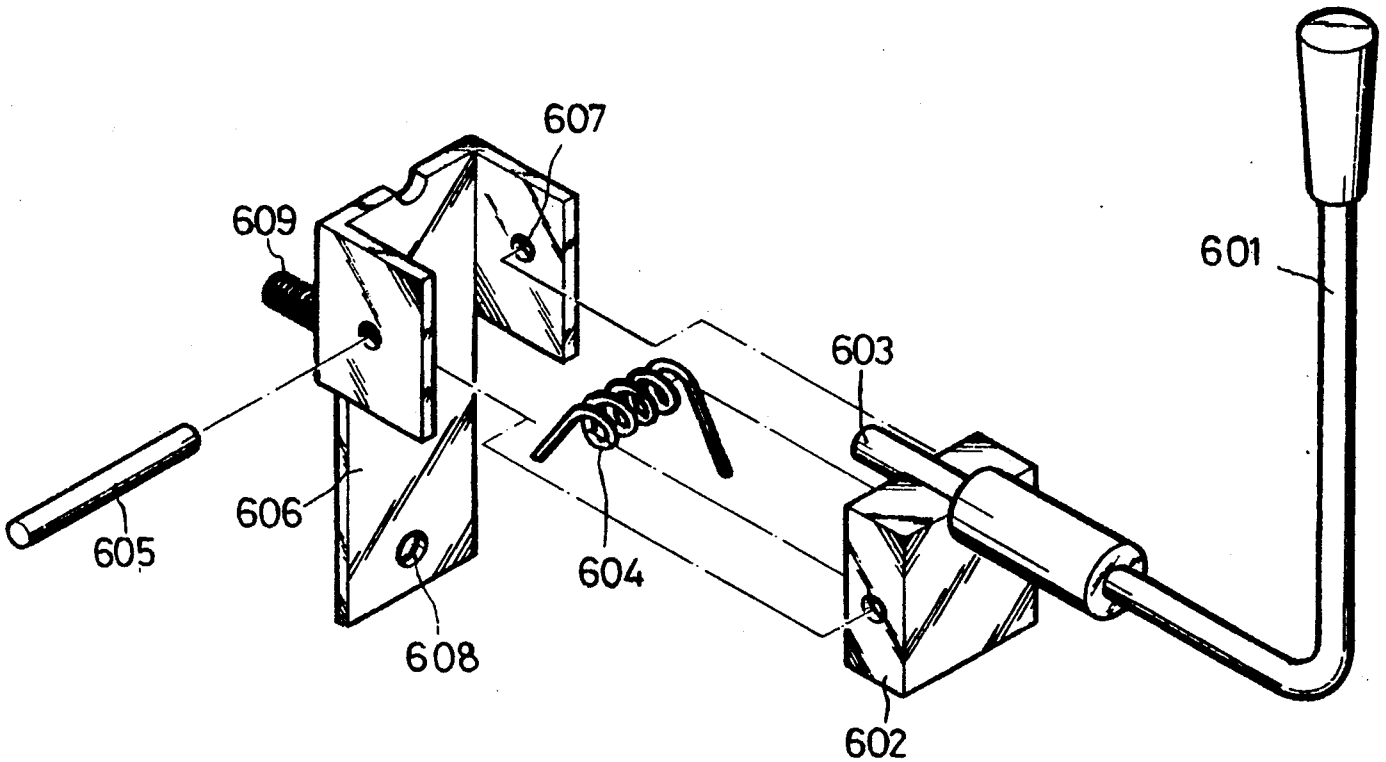
FIG. 2 is a disassembled view of an angle-adjusting assembly of the present invention.
Figure 3:
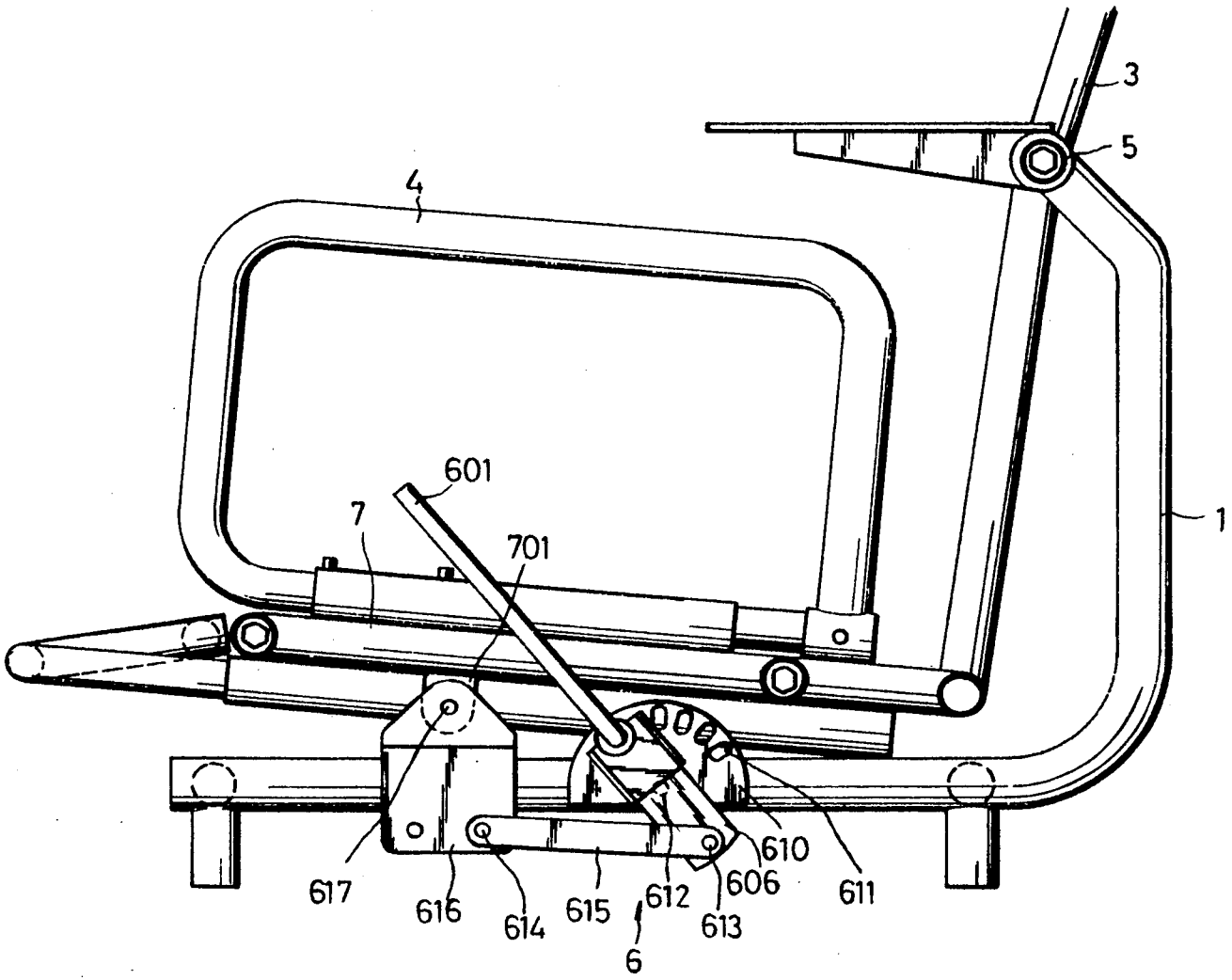
FIG. 3 is a side view of the angle-adjusting assembly according to the present invention.

Referring to FIG. 1, the embodiment according to the present invention comprises a main frame 1, a seat frame 2, a back frame 3 and at least two side frames 4. The seat frame 2 and the back frame 3 are connected together. The center of the back frame 3 has a back frame shaft 5, which is pivotally connected with the main frame 1. The left side of the main frame 1 is mounted with an angle-adjusting assembly 6, which includes four rods (as shown in FIGS. 2 and 3), i.e., a L-shaped control rod 601, of which one end is fixedly mounted to a rod block 602, while the other end thereof is formed into a pin end 603; the rod block 602 is a hollow block, in which a torsional spring 604 is mounted; the control rod 601 and the rod block 602 are pivotally mounted to a turning plate 606 by means of a pin 605 passing through a round hole 607, a hole on the rod block 602, the torsional spring 604. The rear side of the turning plate 601 has a screw rod 609 to pass through a center hole 612 on the disk 610 and to be fixed to the main frame 1 with a nut (not shown). The disk 610 is substantially a semicircular member having a plurality of holes 611 arranged at a regular space. The pin end 603 of the control rod 601 is normally engaged in one of the holes 611. The lower end of the turning plate 606 has a round hole 608 for receiving a pin 613 to position a coupling rod 615, of which the other end is mounted, with a pin 614, on a sliding block 616; the lower end of the sliding block 616 is formed into a U-shaped fork to facilitate the sliding block to mount on the main frame 1 in a slidable manner. The upper end of the sliding block 616 has a pin 617, which is pivotally connected with a pivot lug 701 under the side frame base 7 of the side frame 4. The right side of the main frame 1 is also furnished with a sliding block 616 without control rod 601 and coupling rod 615; the sliding block 616 on the right side is used merely as a supporting member. When the control rod 601 is pushed outwards, the pin end of the rod 601 will become disengaged from the hole 611 on the disk 610, and then the control rod 601 can be moved back and forth freely so as to drive the coupling rod 615 to actuate the sliding block 616; the sliding block 616 will drive the side frame base 7 to move back and forth; simultaneously, the back frame 3 will be turned around the back frame shaft 5 to change the angle of the chair. When a desired angle is adjusted, the user may release the control rod 601 to have the same fixed in one of the holes 611 in the disk 610, and the adjustment is done; in other words, a user can do it by himself (or herself) without using other means.

Figure 4:
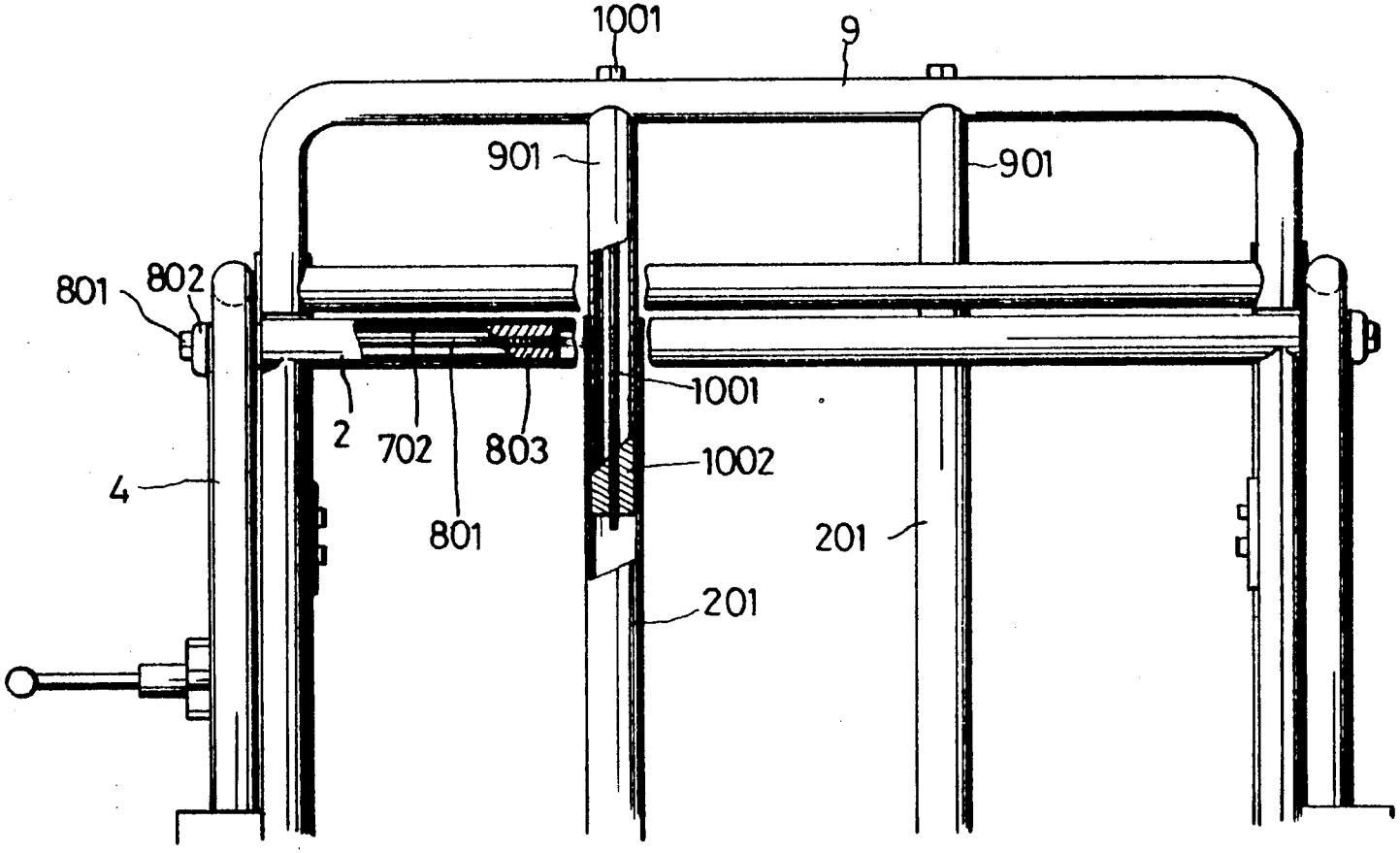
FIG. 4 is a fragmental section view, showing the seat-width adjusting assembly and the seat-depth adjusting assembly according to the present invention.

Referring to FIG. 4, it is a fragmental section view, showing the seat-width adjusting assembly and the seat-depth adjusting assembly. A side frame base 7 is inserted into the pipe of the seat frame 2 (as shown in FIG. 1); an extension screw bolt 801 is also mounted inside the seat frame 2 with a collar 802. The pipe end 702 of the side frame base 7 has a slant portion, which is to be mated with the slant portion of an extension block 803. The extension block 803 is mounted on the screw bolt 801. The outer surface of the extension block 803 is slightly in contact with the inner wall of the seat frame 2. When the extension screw bolt 801 is rotated, the extension block 803 will be moved and slid against the slant portion of the pipe end 702. By means of such wedging effect, the pipe of the side frame base 7 and the extension block 803 can be fixed tightly in the pipe of the seat frame 2, and the space between the side frames 4 can also be adjusted. By means of such an extension screw bolt, the seat-width adjusting assembly 8 can be adjusted, and fixed in a position conveniently.

The conventional chair usually has a fixed depth. In the present invention, the seat includes two parts, i.e., a seat frame 2 and a seat-front edge 9. Two round pipes 901 of the seat-front edge 9 are inserted into the round pipes 201 of the seat frame 2. As soon as the seat-front edge 9 is adjusted in a depth desired, the seat-front edge can be set in place by means of an extension screw bolt 1001 and an extension block 1002, i.e., the extension screw bolt 1001 is inserted in the round pipes 901 of the seat-front edge 9, and the slant portion of the extension block 1002 on the extension screw bolt 1001 is mated with the slant portion of the round pipe 901 to form into a seat-depth adjusting assembly 10. When the extension screw bolt 1001 is rotated, the extension block 1002 will be driven to move so as to have the extension block 1002 and the round pipe 901 clamped the inner wall of the round pipe 201 of the seat frame 2 tightly. The extension screw bolt 1001 is deemed a good design to provide a convenient adjustment.

Figure 5:
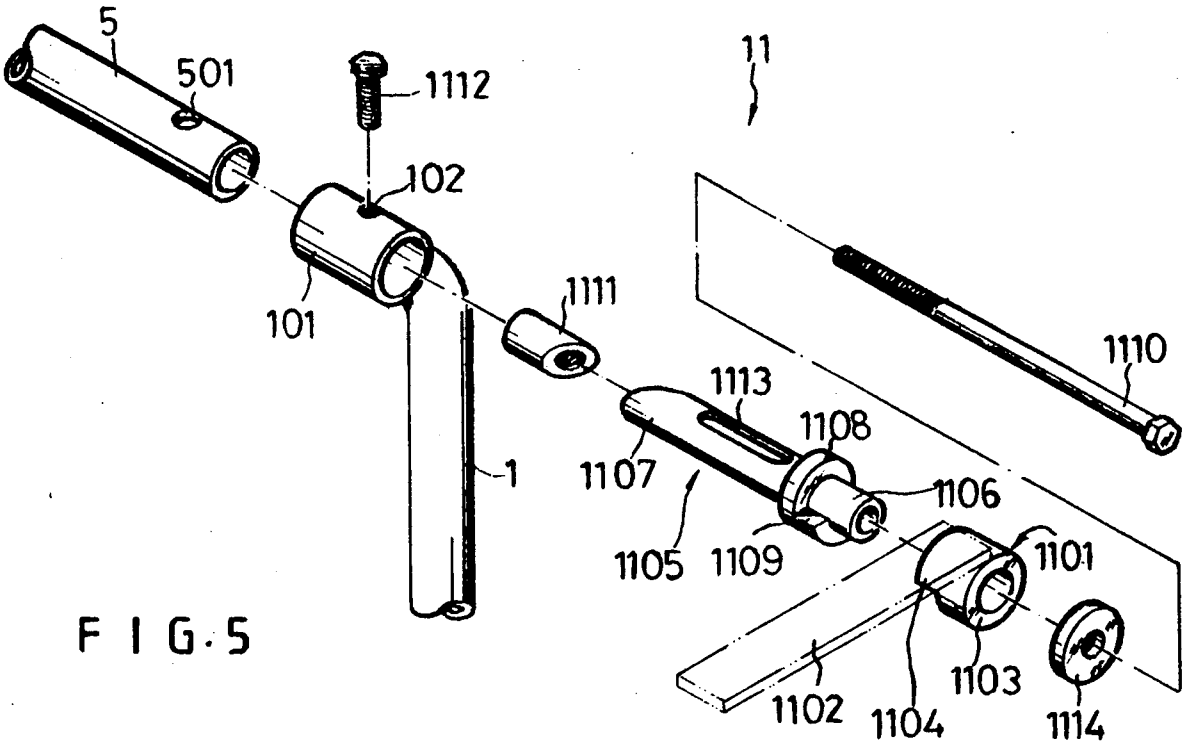
FIG. 5 is a disassembled view of the arm-rest assembly according to the present invention.

FIG. 5 is a disassembled view of the arm-rest assembly. In order to facilitate the angle adjustment of the chair, the arm rest and the side frame are two separate assemblies. The arm-rest assembly 11 includes an arm-rest plate assembly 1101, of which one end is a flat plate 1102, while the rear end thereof is a sleeve 1103 with a through hole; one side of the sleeve 1103 has a lug 1104. The arm-rest plate assembly 1101 is mounted on a front end 1106 of the arm-rest frame 1105, of which the core has a through round hole, while the other end 1107 thereof has a slant portion; the mid ring portion 1108 has a larger diameter and a lug 1109 at one side thereof. After the arm-rest plate assembly 1101 is mounted on the front end 1106 of the arm-rest support 1150, the lug 1104 of the arm-rest plate assembly 1101 will be supported by the lug 1109 of the arm-rest support 1105. The two lugs 1104 and 1109 are so designed in such a manner that the flat plate 1102 of the arm rest plate assembly 1101 will be maintained at a horizontal position when lug 1104 sits on lug 1109. As shown in FIG. 5, lug 1109 has a horizontally-oriented flat surface; therefore, when lug 1104 sits on lug 1109, the flat plate 1102 of the arm rest plate assembly 1101 will be maintained at a horizontal position.

Collar 1114 allows the arm-rest plate assembly 1101 to be pivotably fastened to the arm-rest frame 1105, and thereby, flat plate 1102 is allowed to pivot about the screw bolt 1110. Both lug 1104 and lug 1109 have the shape of a portion of a ring, and collectively they constitute two-thirds of a complete ring. Therefore, when the arm-rest plate assembly 1101 is lifted up and pushed backward, it will stop at about 120° from the horizontal position.

After the screw bolt 1110 is inserted through a collar 1114, the sleeve 1103 of the arm-rest plate assembly 1101, the arm-rest support 1105 and is engaged with an extension block 1111, the aforesaid assembly is inserted in the back frame shaft 5. Both ends of the back frame shaft 5 are to be inserted in a sleeve 101 of the main frame 1, and then are fixed in place by means of a screw 1112 passing through a screw hole 102 of the sleeve 101, a round hole 501 on the back frame shaft 5, and a slot 1113 of the arm-rest support 1105 for adjusting a suitable width (between two arm-rest plate assemblies), and finally the screw bolt 1110 is tightened in place. The arm-rest plate assembly 1101 can be turned backwards at an angle of 120° to let a user sits in comfortably. The space between the two arm-rest plate assemblies 1101 may be adjusted so as to fit one of the users having different body width.

Figure 6:
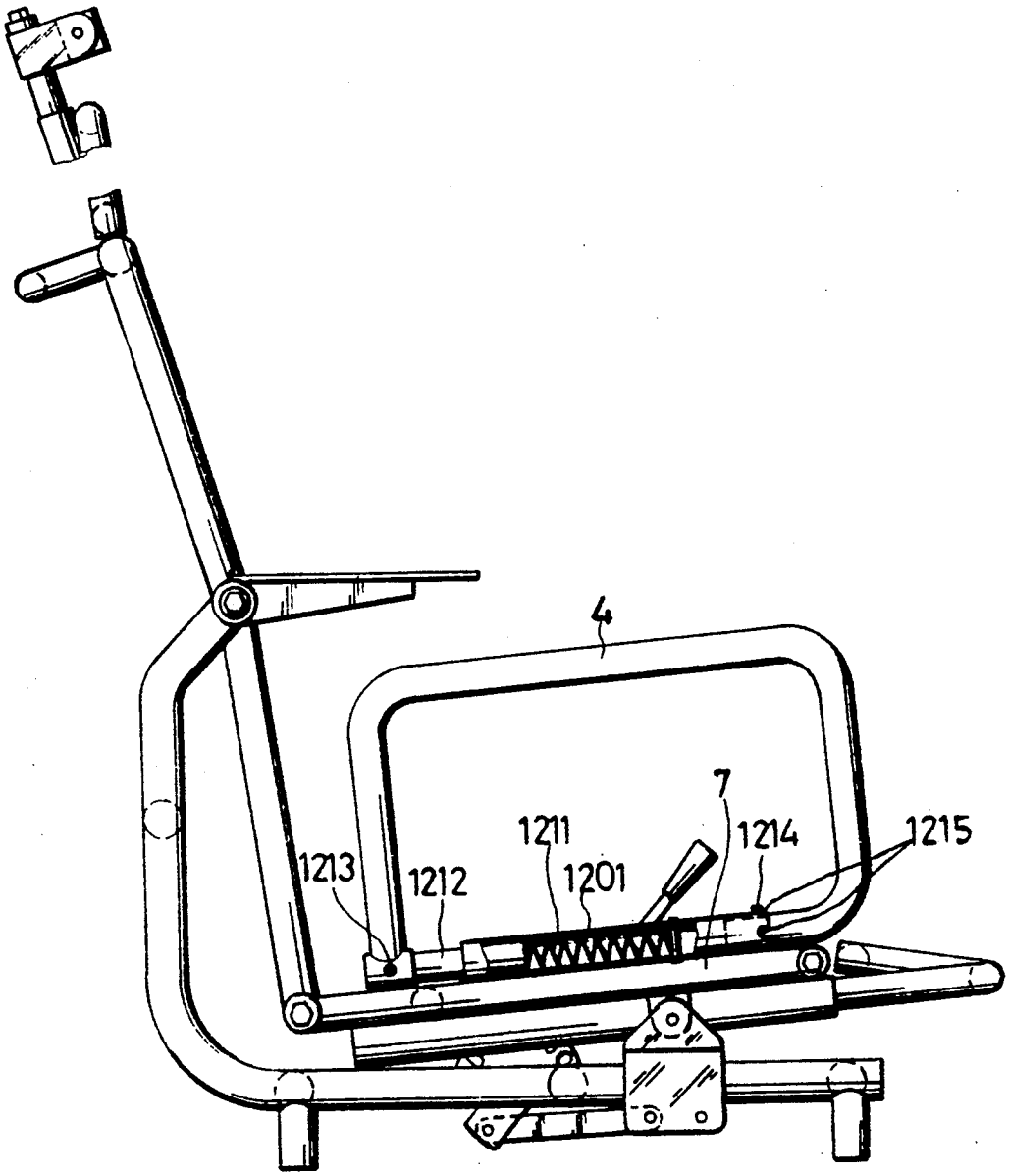
FIG. 6 is a fragmental section view of the side-frame turning assembly according to the present invention.
Figure 7:
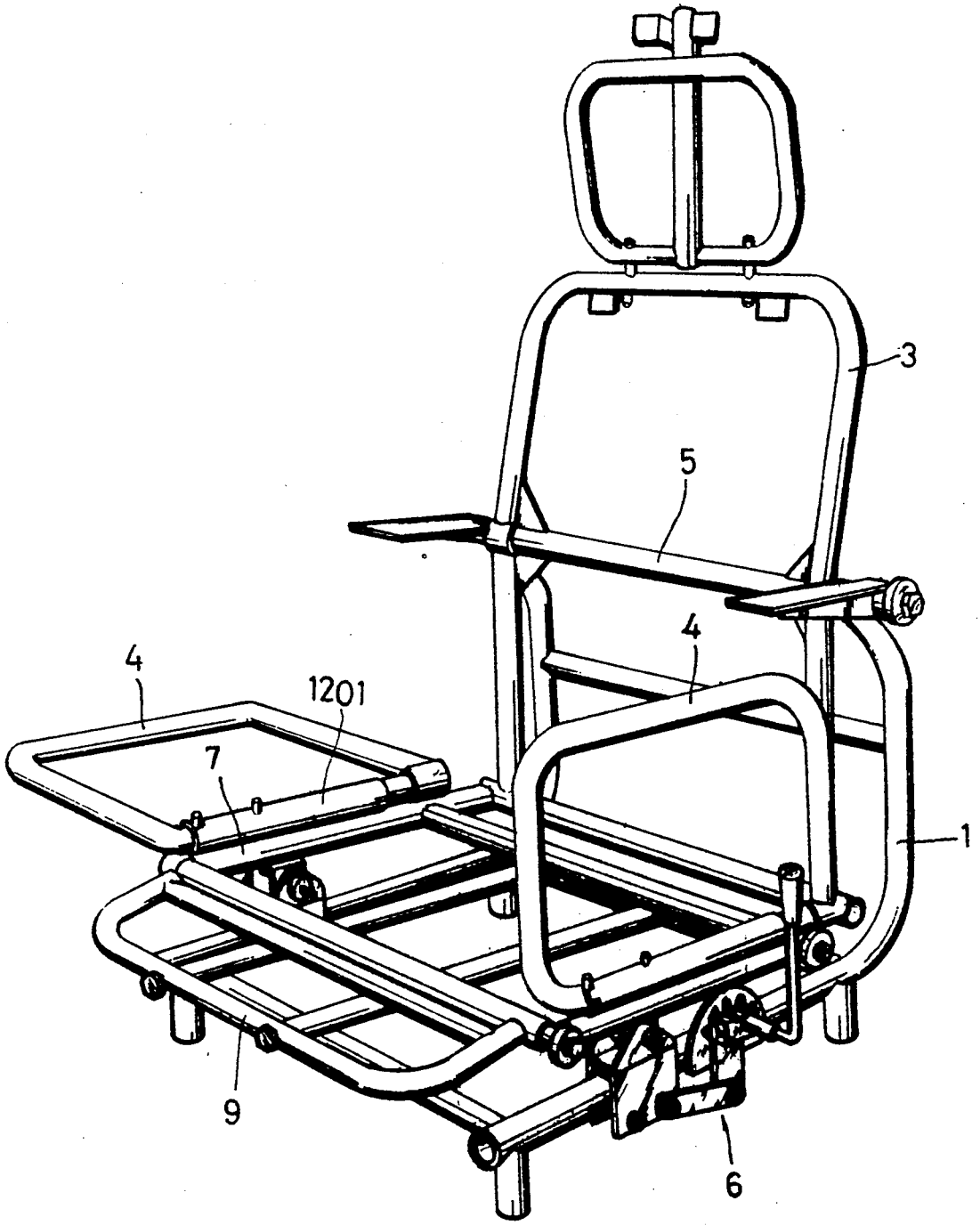
FIG. 7 illustrates the side frame of the present invention being turned at an angle of 90°.

FIG. 6 is a fragmental section view of the side frame 4, of which the lower end is mounted in a round pipe 1201 on the side frame base 7. A spring 1211 is installed in the round pipe for pushing an adjustable rod 1212 to move backwards. As a result of an adjustable rod pin 1213, the side frame 4 attached to the adjustable rod 1212 can also be pushed backwards to cause a fixing pin 1214 on the side frame 4 to be set in a hole 1215 at one end of the round pipe 1201. Push the side frame 4 forwards slightly to have the fixing pin 1214 disengaged from the hole 1215, and then the side frame 4 can be turned outwards at an angle of 90°, i.e., a horizontal position (as shown in FIG. 7); in that case, a user may move the side frame to near a bed edge or a chair so as to move his (or her) body to the bed or the chair slowly and conveniently.

We claim:

1. An adjustable seat assembly for a wheeled chair comprising a main frame, a seat frame, a back frame, and side frames; said adjustable seat assembly further comprising:

an angle-adjusting assembly mounted on said main frame, and including a coupling rod;

a seat-width adjusting assembly including a side frame base fixed under said side frame, both ends of said side frame base being inserted in a round pipe of said seat frame, and said seat-width adjusting assembly being used for adjusting distance between said side frames, and adjusting assembly being fixed in position selected by means of an extension screw bolt and an extension block;

a seat-depth adjusting assembly including a seat-front edge mounted in front of said seat frame, and seat depth being able to change by means of an extension screw bolt and an extension block; and said seat-front edge being able to be fixed in place by means of said extension block and said extension block;

an arm-rest assembly being fixed to said main frame, but being separately designed and mounted from said side frame;

a side-frame turning assembly being mounted in a round pipe on said side frame base, and being able to turn outwards; and by means of aforesaid assemblies, said adjustable seat able to be used by persons having different sizes respectively because angle of said back frame, width and depth of said seat able to be adjusted simply and easily; and said arm-rest plate assemblies able to be turned backwards, and said side frames able to be turned outwards.

2. An adjustable seat assembly for a wheeled chair as claimed in claim 1, wherein said angle-adjusting assembly includes a control rod fixedly mounted on a rod block, and front end of control rod having a pin end; a torsional spring being mounted in said rod block, and a pin being inserted through a round hole on said rod block for attaching said control rod in a turning plate, of which the back side has a screw rod to facilitate said turning plate to be mounted to a center hole of a disk; and said disk being fixed to said main frame; and said disk having several holes; and a pin end of said control being normally engaged in one of said holes of said disk as a result of said torsional spring; whenever said control rod being pushed outwards, said pin end being disengaged from one of said holes immediately; lower end of said turning plate being coupled with a sliding block through pins and a coupling rod, and lower end of said sliding block having a U-shaped fork to be mounted over and along a pipe of said main frame in a slidably manner; and upper end of said sliding block being attached, with a pin, to a pivot lug of said side frame base; and other side of said main frame being provided with a sliding block assembly to provide a supporting function; and when said pin end being disengaged from a hole on said disk, said control rod able to be pushed back and forth to cause said to move, and in turn said back frame able to be moved simul-taneously.

3. An adjustable seat assembly for a wheeled chair as claimed in claim 1, wherein said seat-width adjusting assembly includes an extension screw bolt, and a collar; and said extension screw bolt being inserted in a round pipe of said seat frame; and one end of a round pipe of said side frame base having a slant portion to be mated with an extension block actuated with an extension screw bolt inside a round pipe of said seat frame; and when said round pipe and said extension block of said side frame base becoming clamped together tightly in a round pipe of said seat frame, said side frame base being fixed in place after each adjustment thereof.

4. An adjustable seat assembly for a wheeled chair as claimed in claim 1, wherein an extension screw bolt of said seat-depth adjusting assembly is inserted in a round pipe of said seat-front edge, and said extension screw bolt mounted with an extension block with a slant portion for fixing position of the same.

5. An adjustable seat assembly for a wheeled chair as claimed in claim 1, wherein said seat-depth adjusting assembly includes an arm-rest plate assembly, of which a pipe is inserted together with said arm-rest support; and a sleeve and a ring portion of said arm-rest support each having a lug able to be engaged together to have said arm-rest plate assembly maintained at a horizontal position; and said arm-rest plate assembly able to turn backwards at an angle of 120°; and said arm-rest plate assembly and said arm-rest support being attached to a pipe of said main frame by means of said extension screw bolt, said extension block and said back frame shaft.

6. An adjustable seat assembly for a wheeled chair as claimed in claim 1, wherein a round pipe under said side frame has a spring for pushing an adjustable rod to cause said side frame to move backwards, and to have a fixing pin of said side frame to be engaged in a hole at one end of a round pipe; and when said side frame being pushed forwards, said fixing pin becoming disengaged from said hole, and said side frame able to be turned outwards at an angle of 90°, i.e., a horizontal position.

* * * * *